US007994846B2

(12) United States Patent
Katz et al.

(10) Patent No.: US 7,994,846 B2
(45) Date of Patent: Aug. 9, 2011

(54) METHOD AND MECHANISM TO REDUCE CURRENT VARIATION IN A CURRENT REFERENCE BRANCH CIRCUIT

(75) Inventors: Oded Katz, Haifa (IL); Israel A. Wagner, Zichron-Yaakov (IL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/465,941

(22) Filed: May 14, 2009

(65) Prior Publication Data

US 2010/0289563 A1 Nov. 18, 2010

(51) Int. Cl.
*G05F 3/24* (2006.01)

(52) U.S. Cl. ..... 327/537; 327/541; 327/543; 323/316

(58) Field of Classification Search ..... None
See application file for complete search history.

(56) References Cited

U.S. PATENT DOCUMENTS

| | | | | |
|---|---|---|---|---|
| 5,397,934 | A * | 3/1995 | Merrill et al. | 327/537 |
| 5,646,900 | A | 7/1997 | Tsukude et al. | |
| 6,157,216 | A | 12/2000 | Lattimore et al. | |
| 6,452,448 | B1 | 9/2002 | Bonaccio et al. | |
| 6,731,157 | B2 | 5/2004 | Fulkerson | |
| 7,109,532 | B1 | 9/2006 | Lee et al. | |
| 7,382,180 | B2 * | 6/2008 | Chen | 327/543 |
| 7,501,880 | B2 * | 3/2009 | Bonaccio et al. | 327/534 |
| 2009/0174587 | A1 * | 7/2009 | Ogawa et al. | 341/144 |
| 2010/0007427 | A1 * | 1/2010 | Tomita | 331/117 FE |
| 2010/0019834 | A1 * | 1/2010 | Zerbe et al. | 327/538 |

FOREIGN PATENT DOCUMENTS

WO WO2008/114455 A1 * 8/2008

OTHER PUBLICATIONS

S. C. Terry et al., "Adaptive Gate Biasing—A New Solution for Body-Driven Current Mirrors," GLSVLSI'05; Apr. 17-19, 2005; Chicago, Illinois, USA, pp. 472-477.

* cited by examiner

*Primary Examiner* — Lincoln Donovan
*Assistant Examiner* — Terry L Englund
(74) *Attorney, Agent, or Firm* — Zaretsky & Associates, PC; Suzanne Erez

(57) ABSTRACT

A feedback mechanism to reduce current variation observed in a current reference branch circuit by using body voltage control to compensate process, temperature and supply voltage variations. The current reference output voltage, which is proportional to the reference current, is sampled into a feedback loop, which controls the field effect transistor body voltage. The method and mechanism uses Corner Robust Current Reference in order to keep the design simple and diminish variation between Process Voltage Temperature (PVT) corners. This method exhibits small variation in the reference current magnitude.

13 Claims, 4 Drawing Sheets

METHOD AND MECHANISM TO REDUCE CURRENT VARIATION IN A CURRENT REFERENCE BRANCH CIRCUIT

FIELD OF THE INVENTION

The present invention relates to the field of current mirror circuits, and more particularly relates to method and mechanism for reducing the current variation of the output of a current reference branch circuit used as a current mirror.

SUMMARY OF THE INVENTION

There is thus provided in accordance with the invention, a current reference branch circuit, comprising a main reference branch sub-circuit operative to supply a reference voltage to current source branches and an amplifier operative to reduce output voltage variation of the main reference branch sub-circuit.

There is also provided in accordance of the invention, a current reference branch circuit, comprising a main branch sub-circuit operative to supply a first reference voltage to current source branches and a replica branch sub-circuit operative to reduce output voltage variation of the main branch sub-circuit.

There is further provided in accordance of the invention, a method of reducing current variation in a current reference branch circuit, the current reference branch circuit comprising a metal oxide semiconductor (MOS) transistor connected to a second device via a diode connection, the method comprising the steps of sampling a reference voltage at the gate terminal of the MOS transistor, first feeding said sampled voltage to an input terminal of an amplifier and second feeding the output terminal of the amplifier to a bulk terminal of said MOS transistor.

There is also provided in accordance of the invention, a method of reducing current variation in a current reference branch circuit, the current reference branch circuit comprising a first metal oxide semiconductor (MOS) transistor connected to a terminal of a second device via a diode connection, the method comprising the steps of creating a replica reference branch of the current reference branch circuit, first feeding a reference voltage from the replica reference branch to an input of an amplifier and second feeding an output signal of the amplifier to a bulk terminal of the first MOS transistor.

BRIEF DESCRIPTION OF THE DRAWINGS

The invention is herein described, by way of example only, with reference to the accompanying drawings, wherein.

DETAILED DESCRIPTION OF THE INVENTION

Notation Used Throughout

The following notation is used throughout this document:

| Term | Definition |
|---|---|
| CBD | Controlled Body Device |
| DC | Direct Current |
| FET | Field Effect Transistor |
| IC | Integrated Circuit |
| MOS | Metal Oxide Semiconductor |
| nMOS | n channel Metal Oxide Semiconductor |
| pMOS | p channel Metal Oxide Semiconductor |
| PVT | Process Voltage Temperature |
| SOI | Silicon On Insulator |

DETAILED DESCRIPTION OF THE INVENTION

The present invention provides a feedback mechanism to reduce current variation observed in a current reference branch circuit by using body voltage control to compensate for variations in process, temperature and supply voltage. The current reference output voltage, which is proportional to the reference current, is sampled into a feedback loop, which controls the Field Effect Transistor (FET) body voltage.

The method and mechanism of the present invention uses Corner Robust Current Reference (CRCR) in order to keep the design simple and diminish variation between Process Voltage Temperature (PVT) corners. This method exhibits superior robustness with smaller variation in the magnitude of the reference current.

The present invention is operative to aid in the design of current reference branch circuits with robust current reference, and therefore are not sensitive to variations in PVT variations. (e.g., chaos circuits and other current mode circuits). In addition, current variations are reduced for analog integrated circuits (ICs) working under strict voltage budget, and having a reduced overdrive voltage.

The present invention introduces two embodiments (replica CBD and feedback CBD) for PVT Corner Robust Current Reference. These current reference designs use body voltage control to compensate for variations in process, temperature and supply voltage. These designs also exhibit superior robustness with smaller variation in the reference current magnitude, using Corner Robust Current Reference to keep the designs simple while diminishing variation between corners.

Both replica and feedback embodiments are implemented, using either pMOS devices implemented in a separate n-well in bulk technology (the complementary alternative is nMOS with triple well in bulk technology), or MOS in Silicon on Insulator (SOI) technology. In both cases the transistor is used as a body terminal which can have a body voltage not dependent on the supply voltage or any other device body voltage.

Replica Controlled Body Device

Figure 1:
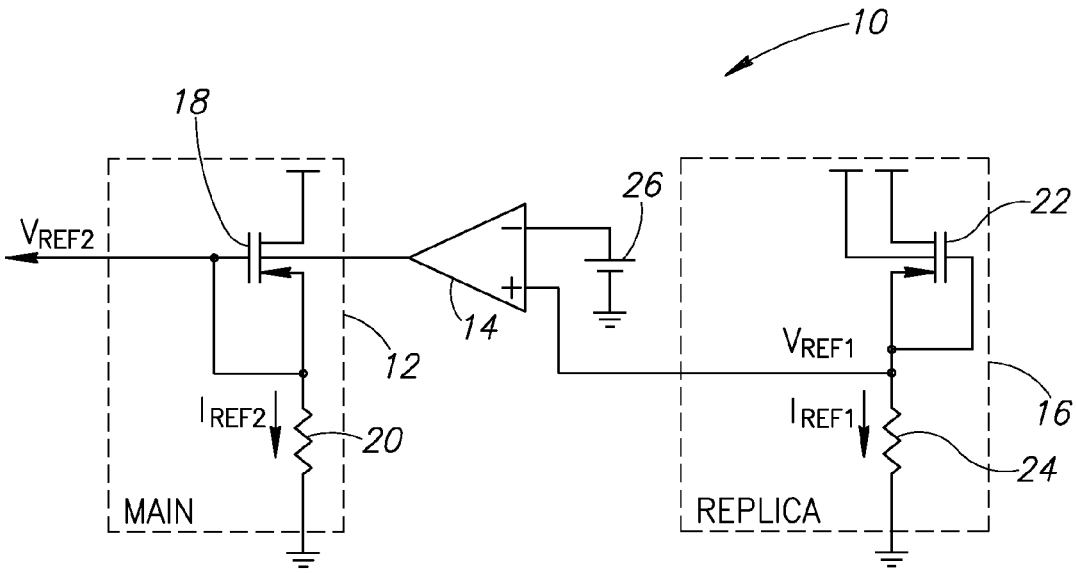
FIG. 1 is a circuit diagram illustrating a current reference branch circuit implementing the replica controlled body device mechanism of the present invention.

In a first embodiment of the present invention, a reference voltage of a replica circuit (i.e. of the current reference branch) is fed into an amplifier, whose output is fed into the bulk terminal of the transistor in the main current reference branch. A schematic diagram of an example circuit implementing the replica controlled body device method of the present invention is shown in FIG. 1. The current reference branch circuit, generally referenced 10, comprises main current reference branch 12, operational amplifier 14, replica current reference branch 16 and direct current (DC) power source 26. The main current reference branch 12 comprises p-channel transistor 18 and resistor 20 connected via a diode connection. The replica current reference branch 16 comprises p-channel transistor 22 and resistor 24 connected via a diode connection.

The replica circuit 16 comprises a simple current reference branch, which is used as a replica for the main current reference branch. The reference voltage $V_{ref1}$ (i.e. the voltage at the diode connection) of this branch is fed into the operational amplifier. Therefore, the variation in reference voltage of the simple current reference branch due to process threshold voltage variation is amplified at the amplifier output. In turn, the amplifier output voltage controls the body current of transistor 18, a component of the main current reference branch 12.

In the main current reference branch 12, if the threshold voltage $V_T$ is increased, the current $I_{ref1}$ in the branch decreases, and as a consequence the reference voltage $V_{ref2}$ drops. The transistor threshold voltage $V_T$ depends on the difference between source and bulk voltage according to:

$$|V_T| = |V_{T0}| + \gamma(\sqrt{|V_{SB}+2\phi|} - \sqrt{|2\phi|}) \quad (1)$$

where $\gamma$ is the body effect coefficient, $2\phi$ is the intrinsic silicon bend banding constant (negative for pMOS and positive for nMOS), $V_{SB}$ is the source to body voltage, and $V_{TO}$ is the threshold voltage at $V_{SB}=0$. We can use this dependence to manipulate the effective threshold voltage value $V_T$.

Consider the case of an increase in the absolute value of threshold voltage $|V_{T0}|$ due to process variations. This will cause a decrease in the reference voltage $V_{ref1}$ of the replica branch 16, and a decrease in the amplifier output voltage, which is also connected to the body voltage of the of transistor 18. Looking at Equation (1) for transistor 18, the first term, $|V_{T0}|$, is increased due to process variations, however the second term, $\gamma(\sqrt{|V_{SB}+2\phi|} - \sqrt{|2\phi|})$, decreases due to the change in body voltage and compensates the increase in the first term, thus having smaller change in the effective threshold voltage. Therefore, the current $I_{ref2}$ in the main current reference branch 12 will have less sensitivity to any variation in the threshold voltage, $V_{T0}$, as opposed to current $I_{ref1}$ in the replica reference branch 16 or the current $I_{ref2}$ in the main reference branch 12 in the case where both source and body terminals of transistor 18 are connected to Vdd (i.e. a current reference circuit with no feedback from amplifier 14).

Feedback Controlled Body Device

Figure 2:
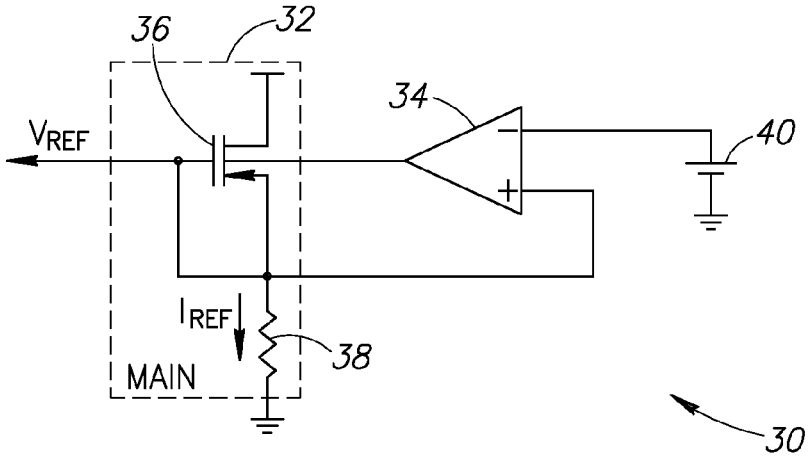
FIG. 2 is a circuit diagram illustrating a current reference branch circuit implementing the feedback controlled body device mechanism of the present invention.

In a second embodiment of the present invention, the reference voltage of the current reference branch circuit is fed into an amplifier, whose output is fed back into the bulk terminal of the transistor in the current reference branch. A schematic diagram of an example circuit implementing the replica controlled body device method of the present invention is shown in FIG. 2. The current reference branch circuit, generally referenced 30, comprises main current reference branch 32, operational amplifier 34 and DC current source 40. Main current reference branch 32 comprises p-channel transistor 36 connected to resistor 38 via a diode connection. This feedback method does not require a replica reference branch (i.e. employed by the first embodiment), thereby saving area (i.e. space in the circuit) and power. In this embodiment reference branch voltage $V_{ref}$ is sampled and fed into an amplifier (in this case, an operational amplifier). The amplifier output is connected to the body terminal of transistor 36. As with the first embodiment, an increase in the absolute value of threshold voltage $|V_{T0}|$ (i.e. due to process variations) causes a decrease in the reference voltage $V_{ref}$, and a decrease in the amplifier output voltage, which is also connected to the body voltage of transistor 36. Applying Equation (1) to transistor 36, $|V_{T0}|$ increases due to process variations. However, $\gamma(\sqrt{|V_{SB}+2\phi|} - \sqrt{|2\phi|})$ decreases due to the change in body voltage. This compensates the increase in $|V_{T0}|$, resulting in a smaller change in the effective threshold voltage. Therefore, the current in the main reference branch 32, $I_{ref}$ will have less sensitivity to variations in threshold voltage $V_{T0}$. Due to the feedback connection, the gain will be smaller, and thus the compensation of the effective threshold voltage will be smaller than in the replica scheme.

Figure 3:
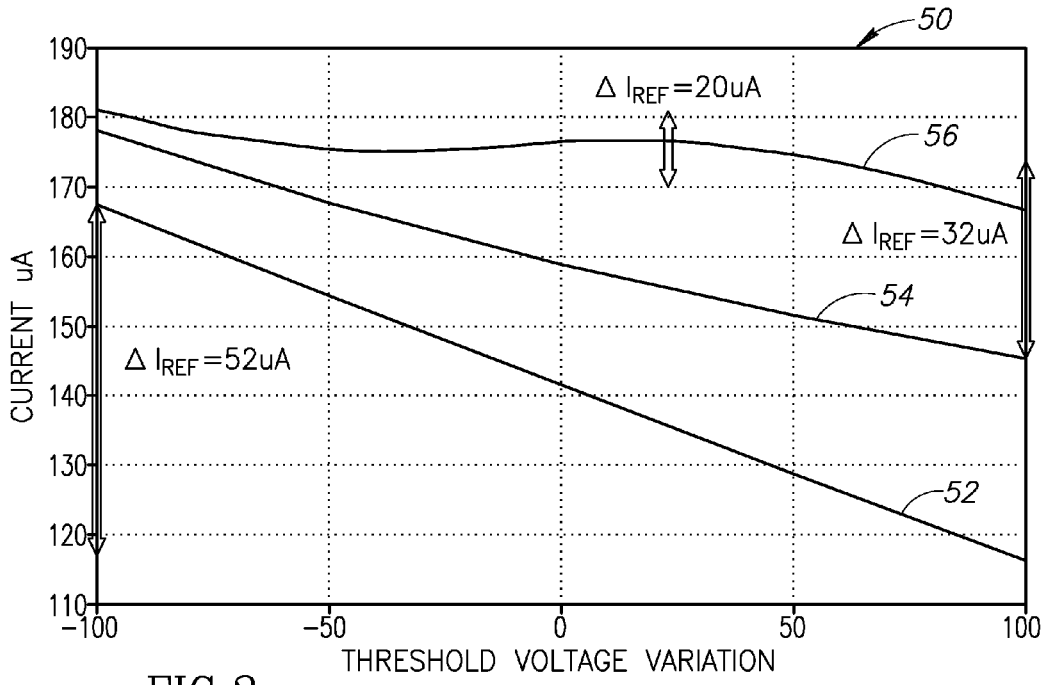
FIG. 3 is a chart illustrating reference current as a function of threshold voltage variations for example circuits implementing the replica branch and feedback methods of the present invention

A graph showing reference current as a function of threshold voltage variations for example circuits implementing the replica branch and feedback methods of the present invention is shown in FIG. 3. The graph, generally referenced 50, comprises plot 52 of reference current for a simple reference branch (i.e. a current reference branch with no body control), plot 54 of reference current for a current reference branch implementing the feedback method of the present invention and plot 56 of reference current for a current reference branch implementing the replica branch method of the present invention.

The graph 50 shows that the current variations are about 9% for the replica method, as opposed to 32% in the simple reference branch. The graph also shows that the current variation is about 18% for the feedback method.

Figure 4:
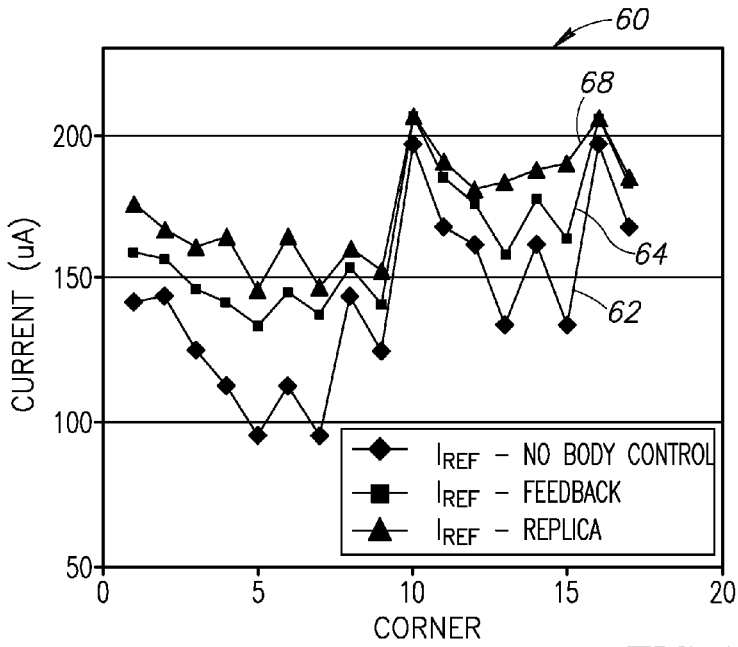
FIG. 4 is a chart illustrating the resulting reduced current variation at PVT corners for circuits implementing the replica branch and feedback methods of the present invention.

A graph showing reference current for PVT corner combinations in example circuits implementing the method of the present invention is shown in FIG. 4. The graph, generally referenced 60, comprises plot 62 (diamond pattern) of reference current for a simple reference branch (i.e. no body control), plot 64 (square pattern) of reference current for a circuit implanting the feedback method of the present invention (as shown in FIG. 2) and plot 68 (triangle pattern) of reference current for a circuit implanting the replica branch method of the present invention (as shown in FIG. 1). The Y axis indicates the measured reference current for the PVT corner combinations (i.e. the X axis low/high temperature, low/high supply voltage, low/high pMOS threshold voltage, and low/high nMOS threshold voltage. (i.e. resulting in 16 corners). For the simple reference branch (no body control), the graph shows a current variation (i.e. between PVT corners) of about 105 μA, a current variation of about 70 μA for a circuit implementing the feedback method of the present invention and about 60 μA for a circuit implementing the replica branch method of the present invention. Therefore, both the replica branch and feedback embodiments of the present invention method show improved tolerance to variations in temperature, supply voltage and process.

Figure 5:
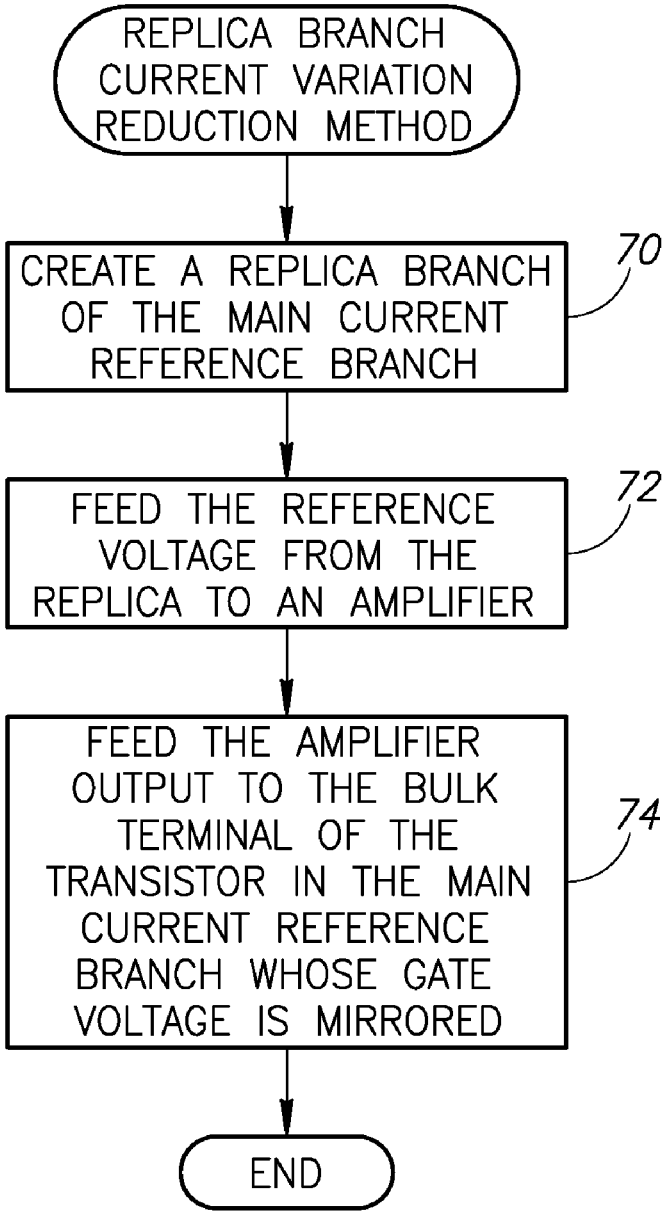
FIG. 5 is a flow diagram illustrating the feedback method of the present invention.

A flow diagram illustrating the replica branch current variation reduction method of the present invention is shown in FIG. 5. First, a replica branch of the main current reference branch is created (step 70). The reference voltage observed at the diode connection of the replica branch is then fed into an amplifier (step 72). Finally, the output from the amplifier is fed to the bulk terminal of the transistor in the main current reference branch whose current (or gate voltage) is mirrored (step 74).

Figure 6:
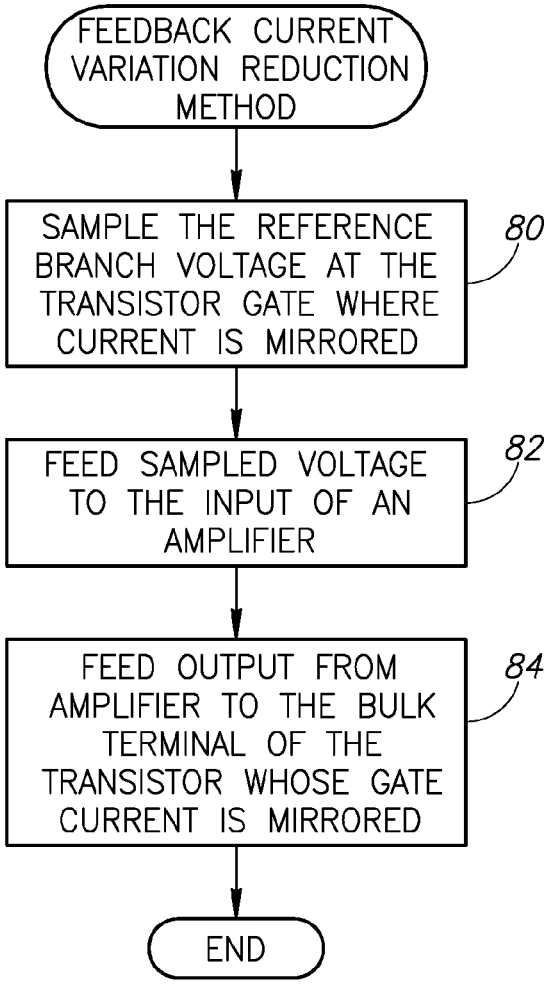
FIG. 6 is a flow diagram illustrating the replica branch method of the present invention.

A flow diagram illustrating the feedback current variation reduction method of the present invention is shown in FIG. 6.

First, the reference branch voltage (i.e. the voltage at the transistor gate where the current is mirrored) is sampled (step 80). The sampled voltage is then fed as an input into an amplifier (step 82). Finally, the amplifier output is fed to the bulk terminal of the transistor in the current reference branch whose gate current is mirrored (step 84).

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It is intended that the appended claims cover all such features and advantages of the invention that fall within the spirit and scope of the present invention. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention.

What is claimed is:

1. A current reference branch circuit, comprising:

a main reference branch sub-circuit operative to supply a second reference voltage to current source branches, said main reference branch circuit comprising a transistor having a body terminal; and a replica reference branch sub-circuit operative to replicate said main reference branch sub-circuit, said replica reference branch sub-circuit comprising a load resistance operative to generate a first reference voltage in response to current variations through said load resistance; and an amplifier operative to receive a DC reference voltage at an inverting input and said first reference voltage at a non-inverting input, whereby said amplifier is operative to track the current variations through said load resistance caused by variations in process threshold voltage and to modify a body voltage applied to said body terminal in response thereto which functions to compensate for said process threshold variations, thereby minimizing output voltage variation of said main reference branch sub-circuit.

2. The circuit according to claim 1, wherein said main reference branch sub-circuit comprises:

said transistor comprising a metal oxide semiconductor (MOS) transistor comprising said body terminal; and a second resistance connected to a drain terminal and a gate terminal of said MOS transistor via a diode connection.

3. The circuit according to claim 2, wherein said second resistor resistance is chosen from a group consisting of an MOS transistor and a resistor.

4. The circuit according to claim 1, wherein said replica reference branch sub-circuit comprises:

a metal oxide semiconductor (MOS) transistor; and said load resistance connected to a drain terminal and a gate terminal of said MOS transistor via a diode connection.

5. The circuit according to claim 4, wherein said load resistance is chosen from a group consisting of an MOS transistor and a resistor.

6. The circuit according to claim 1, wherein said amplifier is chosen from a group consisting of an operational amplifier and a differential amplifier.

7. The circuit according to claim 4, wherein an output of said amplifier, to modify the body voltage, is connected to said body terminal.

8. The circuit according to claim 1, wherein apparatus for implementing said current reference branch circuit is chosen from a group consisting of silicon on insulator technology and bulk technology with double well and triple well MOS devices.

9. A method of reducing current variation in a main current reference branch circuit, said main current reference branch circuit comprising a first transistor having a body terminal, the method comprising the steps of:

providing a replica current reference branch comprising a second transistor and a load resistance;

providing an amplifier having an inverting input and a non-inverting input;

applying a DC reference voltage to said inverting input;

sensing current variations through said load resistance in said replica current reference branch and generating a first reference voltage in response thereto that is applied to said non-inverting input of said amplifier;

tracking and compensating for said current variations through said load resistance caused by variations in process threshold voltage by generating a modifying a body voltage in accordance an output of said amplifier; and applying said modified body voltage to said body terminal of said first transistor in said main current reference branch which functions to compensate for said process threshold variations, thereby minimizing output variation of said main current reference branch circuit.

10. The method according to claim 9, wherein said load resistance is chosen from a group consisting of an MOS transistor and a resistor.

11. The method according to claim 9, wherein said amplifier is chosen from a group consisting of an operational amplifier and a differential amplifier.

12. The method according to claim 9, wherein said replica current reference branch comprises:

said second transistor comprises a metal oxide semiconductor (MOS) transistor; and said load resistance connected to a drain terminal and a gate terminal of said second transistor via a diode connection.

13. The method according to claim 10, wherein said main current reference branch comprises a second load resistance chosen from a group consisting of an MOS transistor and a resistor.

* * * * *